US005208409A

United States Patent [19]

Roulet

[11] Patent Number: 5,208,409

[45] Date of Patent: May 4, 1993

[54] VIOLIN SHOULDER REST

[76] Inventor: Paul-Antoine Roulet, Les Jordils 1, CH-2016 Cortaillod, Switzerland

[21] Appl. No.: 664,012

[22] Filed: Feb. 28, 1991

[30] Foreign Application Priority Data

Mar. 2, 1990 [FR] France ..... 90 02771

[51] Int. Cl.[5] ..... G10D 1/02

[52] U.S. Cl. ..... 84/278; 84/280

[58] Field of Search ..... 84/278, 279, 280 R, 84/280 C, 281

[56] References Cited

U.S. PATENT DOCUMENTS 4,212,222 7/1980 Henkle ..... 84/278

FOREIGN PATENT DOCUMENTS 287520 10/1988 European Pat. Off. .

277350 11/1951 Switzerland .

2052828 1/1981 United Kingdom .

*Primary Examiner*—Michael L. Gellner

*Assistant Examiner*—Cassandra Spyrou

*Attorney, Agent, or Firm*—Sughrue, Mion, Zinn Macpeak & Seas

[57] ABSTRACT

This violin shoulder rest essentially comprises a support piece (1) intended to rest against the shoulder of the violinist, and a rigid arm (2) fastened to the base (3) of the chin rest. The support piece (1) is rigidly attached to the arm (2) by three clamping pieces but in an adjustable manner, in slope and angle relative to the arm (2) and in distance to the end of the violin. When such adjustments have been effected, the rigid attachment of the support piece (1) to the arm (2) is obtained by means of a single screw (25) which does not risk coming unscrewed in an untimely manner.

5 Claims, 4 Drawing Sheets

VIOLIN SHOULDER REST

This invention concerns a shoulder rest for a violin which comprises in particular a support piece intended to rest against the shoulder of the violinist, such support piece being rigidly secured to an arm, but in a manner to enable adjusting on the one hand its inclination and angle relative to such arm and, on the other hand, the position thereof along such arm, such latter itself being rigidly secured to the base of the chin rest, which is located under the violin.

BACKGROUND OF THE INVENTION

A rest of this type is described in patent U.S. Pat. No. 4,212,222. In this case, the arm which bears the support piece presents a downwardly turned convex cylindrical surface. To this surface are fitted two clamping pieces which are complementary to such cylindrical surface, the assembly being maintained by a single screw and nut. This construction leads to an awkward adjustment for the violinist, since he will be able to adjust the position of the support in rotation relative to the axis of the screw only in effecting rotation of such support itself. Furthermore, the adjustment in rotation is independent of the other adjustments and in particular of the inclination of the support.

A further difficulty of this known rest is that an untimely shock on the support piece loosens the nut which causes loss of the adjustment and obliges the violinist to repeat such operation. Now, such a shock may be imparted to the support during the performance of a piece of music, this naturally being completely unacceptable.

The purpose of the invention is to overcome the difficulties of the shoulder rest described in this prior document.

SUMMARY OF THE INVENTION

The invention has thus as purpose a shoulder rest for a violin comprising a support piece intended to rest against the shoulder of the violinist, such support piece being rigidly secured to an arm but in a manner to enable adjusting on the one hand its inclination and angle relative to such arm and, on the other hand, its position along such arm, this latter itself being rigidly secured to the base of the chin rest which is located under the violin, for which shoulder rest a single cap screw rigidly fixes the support piece to said arm in the position as adjusted, both along the arm and in transversal inclination to such arm, such cap screw passing through a first clamping piece, said support piece, a second clamping piece and said arm, so as to engage with a third clamping piece and thereby compress together the arm, the support piece and the first and second clamping pieces, such support being characterized in that the first and second clamping pieces have complementary surfaces at least approximately in the form of respectively convex and concave spherical caps, and in that the support piece exhibits a portion approximately in the form of a spherical shell gripped between the first and second clamping pieces.

Thanks to these characteristics, it is possible to place the rest in any position whatsoever by a single movement and thus there is a particularly convenient adjustment operation for the user.

According to patent CH-A-277,350, there is known another shoulder rest which likewise includes numerous disadvantages, some of which are found moreover in the support described in the previously cited U.S. patent. In this case, the end of the arm with parallel edges, but of trapezoidal section, is simply fitted into a dovetail opening in the base of the chin rest. If it is possible to adjust the end of the trapezoidal profile arm to the dovetail opening in the chin rest, at least at the beginning, there must not be forgotten that the shoulder rest must be separated from the violin, that is to say, the arm must be removed from the chin rest following each performance in order to permit placing the violin in its case, then such arm must be reintroduced in place in the opening in the base of the chin rest for each new performance. Now repetition of such manoeuvres produces without fail a certain wear by friction of the parts in contact which may go so far as to render completely uncertain the securing of the arm to the base of the chin rest. Previously, the wear in question produced progressive play of the arm in the chin rest which brought about unseemly noises during performances, such as a violinist cannot permit during a concert.

Other disadvantages of the rest known from patent CH-A-277,350 arise from the screw provided to block the support piece in the desired inclination relative to the arm. Situated between the support piece and the violin, it has as effect by its length to distance in an exaggerated manner the support piece from the violin. Furthermore, following an accidental violent pressure, for instance between the chin rest and the support piece, the head of the screw in question risks causing serious damage to the body of the violin. Finally, in the chosen position, access to the head of such screw is awkward which renders difficult a suitable locking. The adjustment of the spread between the support piece and the end of the violin is brought about through another screw still more awkward of access.

The shoulder rest described in the cited Swiss patent further possesses two regulating nuts fitted on a threaded sleeve surrounding the screw for blocking the inclination of the support piece. The least play of such sleeve around the blocking screw as well as insufficient tightening of the two adjustment nuts constitutes further sources of unseemly noises which are unacceptable for a violinist during a concert.

The adjustment of the known shoulder rest thus is revealed as being laborious, awkward and unsatisfactory. In addition, as in the case of patent U.S. Pat. No. 4,212,222, the screws and nuts intended to lock the support piece in the adjusted position may accidentally come undone in the course of performance with effects which can be very disagreeable.

Trials effected on the shoulder rest according to this invention have shown that an inclination of the support piece relative to the arm on the order of 15° both in the longitudinal sense in approaching the violin tail piece as well as in the transversal sense in going away from the support piece of the violin body in the direction of the e string give satisfaction to violinists with very few exceptions. It is thus recommended to give initially such standard inclinations to the support piece relative to said arm when the complementary surfaces of the first and second clamping pieces as well as the portion in the form of a shell of the support piece are in a position corresponding to an intermediate position since it is from this position that the inclination of the support piece may be modified to the greatest degree in any direction whatever, which amply suffices to satisfy the needs of all violinists.

The base of the chin rest which is supported under the violin is normally coupled to the chin rest as such which rests on the violin by two risers. Now there are numerous violinists who arrange such two risers in the center of the end of the violin being on either side of the tail pin. There are, however, violinists who arrange the two risers for securing the chin rest laterally, both being to the left of the tail pin, that is to say, at the side of the g string. In order that the chin rest according to the invention may be employed in both cases, the cap screw which secures the support piece to the arm of the chin rest, advantageously traverses the support piece in an offcentered point which is thus situated at unequal distances from the ends of the support piece. By reference to a position of the support piece relative to the support arm which is suitable for a central chin rest, it is sufficient thus to rotate the support piece by 180° relative to the arm in order to render the support according to the invention likewise employable with a side chin rest.

In order to assure the mentioned inclinations of the support piece relative to the support arm, it has appeared that the most simple manner was to bring about a progressive variation of the thickness of the second clamping piece around its axis. If this complicates somewhat the machining of such clamping piece from a metal slug, it is on the other hand very easy to mould it of synthetic material of sufficient hardness.

The adjustment of the position of the support piece along the support arm may be very easily assured. It is sufficient in effect to provide a longitudinal slot in the support arm in a manner such that the securing screw for the support piece to such arm may go through such slot. This permits then to displace easily such screw as well as the clamping pieces and the support piece along the arm and to fix the support piece in any position whatsoever compatible with the length of the slot provided in the arm.

It is also very easy to prevent the screw for securing the support piece to the arm of the rest to come unscrewed in an untimely manner. For this it is sufficient to block the clamping pieces from rotation. This may be brought about for instance in nesting prismatic portions of the first and second clamping pieces into one another and in providing the second and third clamping pieces with pairs of diametral spurs which are fitted into the longitudinal slot of the arm thus being blocked in rotation. Thus, even if the support piece accidentally undergoes a shock which displaces the orientation thereof relative to the arm of the rest, such displacement of the support piece has no influence on the securing screw to the arm since such screw and the three clamping pieces are bound to the arm.

Finally, it is possible to secure rigidly the arm of the shoulder rest to the base of the chin rest in a manner absolutely exempt of all unseemly noise. To this end, the free end of the arm may be conformed and introduced into a dovetail opening in the base of the chin rest as in the known case mentioned hereinabove, but in providing a certain play of the arm in the chin rest base opening and in adding a screw fitted into the arm the end of which bears against the base of the chin rest in order to strongly apply the inclined faces of the arm against those of the dovetail opening in the base of the chin rest in a direction perpendicular to the base of the chin rest and to the arm. Such screw may be acted on directly with the help of a suitable tool (wrench, screwdriver). It is at the same time preferable for the violinist who must act on the screw in question before and after each performance, to have an adjustment tongue fastened to the end of the screw coming out of the arm, such tongue being exactly superposed on the arm when the screw is tightened to the maximum.

An embodiment of the shoulder rest according to the invention is schematically shown and simply by way of example in the attached drawings.

DESCRIPTION OF THE PREFERRED EMBODIMENT

Figure 1:
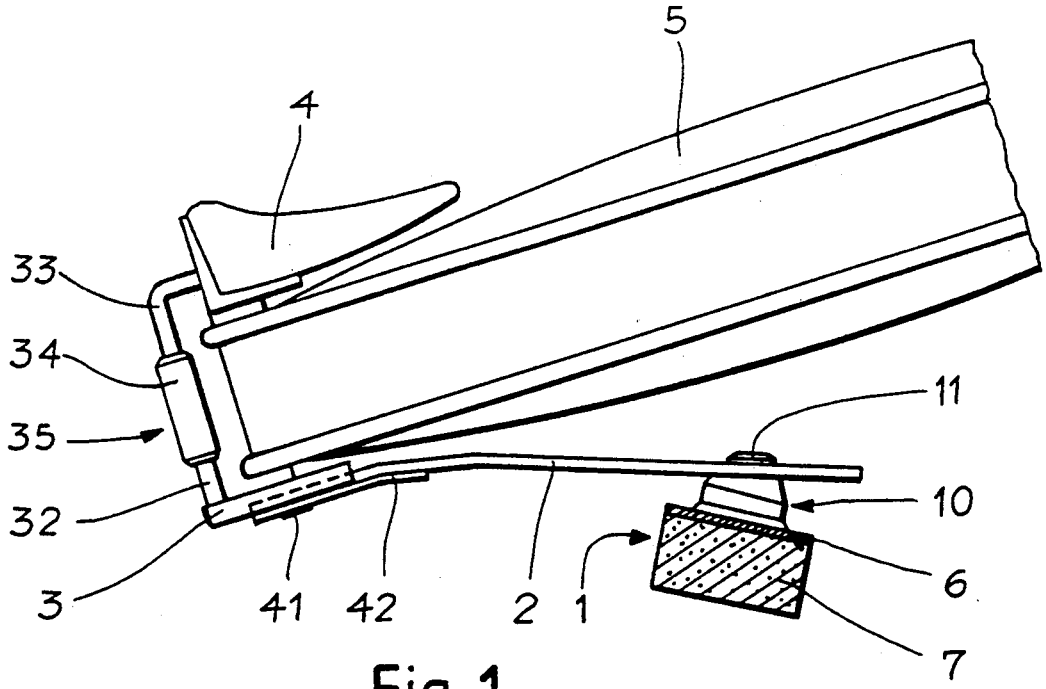
- FIG. 1 is an elevational view, partially cut away, of the shoulder rest secured to a violin in the operating position.
Figure 2:
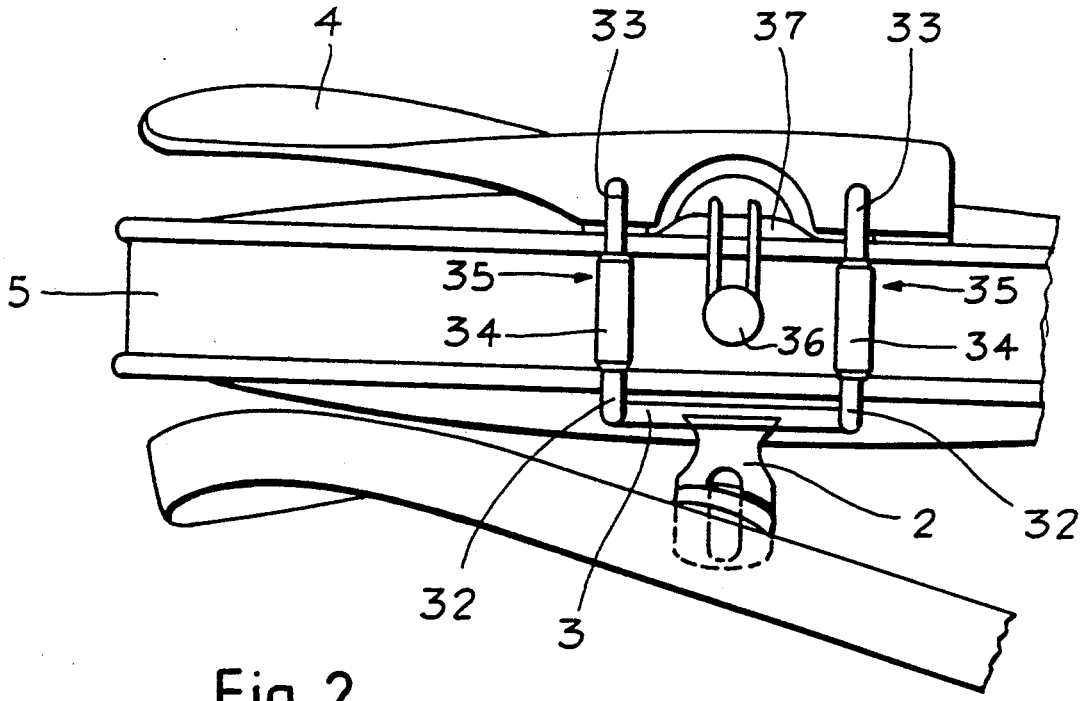
- FIG. 2 is a view of the elements of FIG. 1 from the left of such figure.

The shoulder rest shown is essentially composed by a support piece 1 which is secured in an adjustable manner to an arm 2. In use, the latter is itself secured to the base 3 of a chin rest 4 (FIGS. 1 and 2). The support piece 1 occupies a transversal position relative to the body 5 of the violin. It is intended to be closely applied against the shoulder of the violinist in a manner such that the violin is held solely by gripping between the chin and the shoulder of the violinist, without any effort from the left hand which is thus completely free to jump from one position to the other along the strings of the violin.

Piece 1 comprises a base plate 6 of rigid material, preferably steel. It could nevertheless also be formed of hard synthetic material. It is upholstered by a cushion 7 of flexible matter more or less thick. Piece 1 is narrow. Its length approaches the width of the violin. Such piece 1 may be rectilinear, preferably however one gives it the form of an "S", in folding back slightly the ends in order that it best match the form of the violinist's body.

Figure 4:
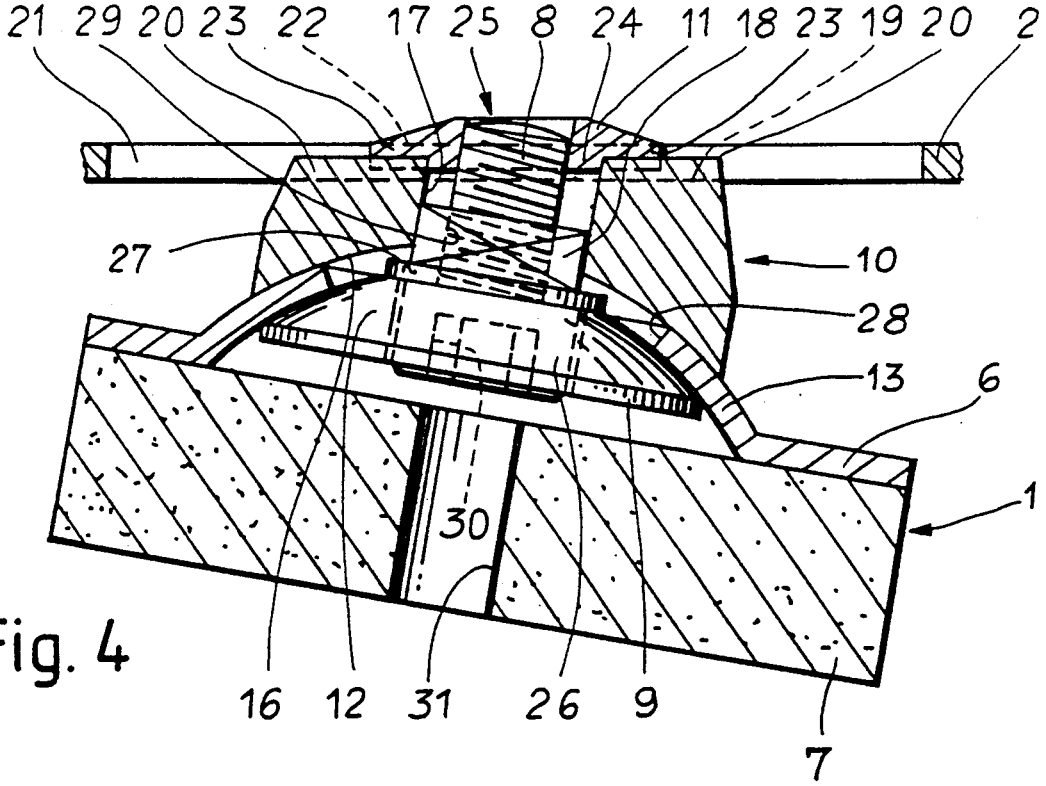
- FIG. 4 is a longitudinal cross-section relative to the violin of a detail to a larger scale.
Figure 7:
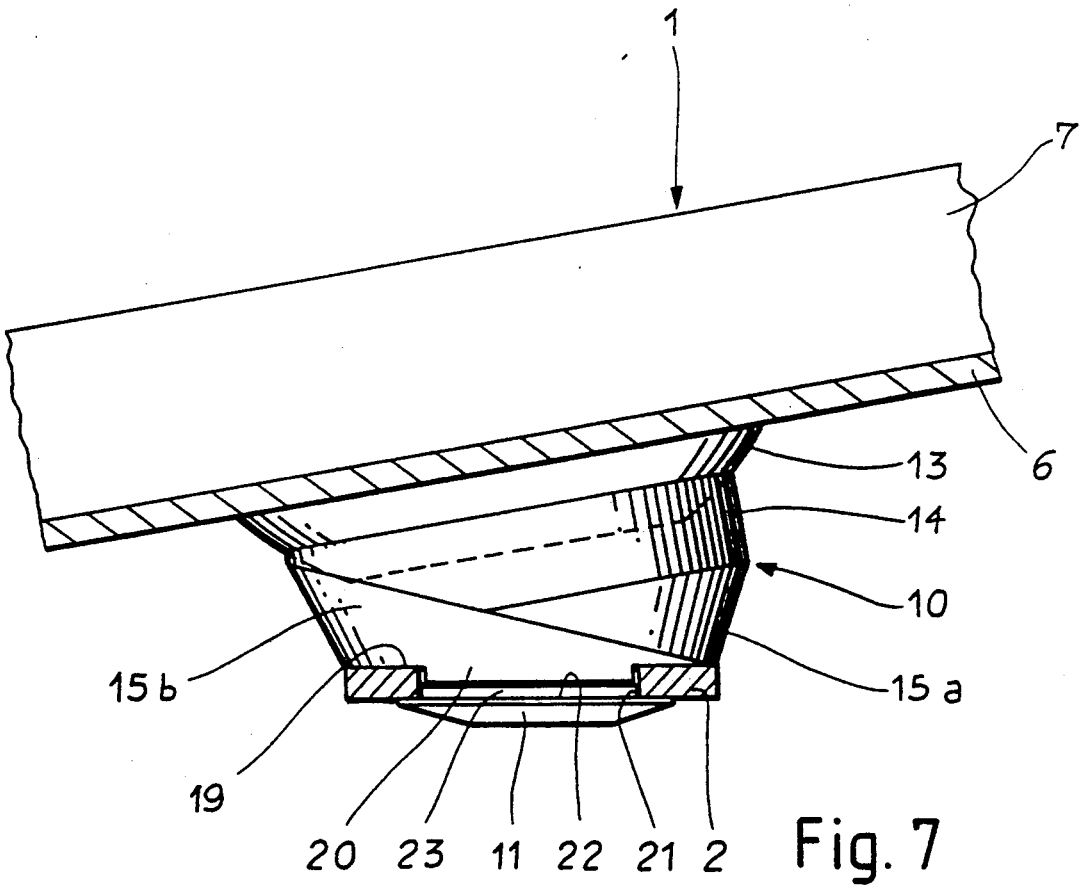
- FIG. 7 is a partial elevational view of the mounted rest with the parts cut away in the transversal sense relative to the violin.

The securing of piece 1 to arm 2 is shown in detail on FIGS. 4 and 7. It is brought about with the help of a screw 8 and three clamping pieces 9, 10, 11. The first clamping piece 9 has a surface 12 generally in the form of a convex spherical cap. It is housed at the center of piece 1 between an embossed portion 13 of plate 6 and the cushion 7.

Figure 5:
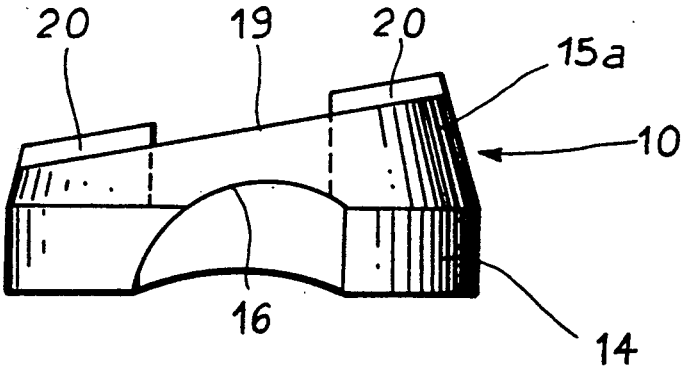
- FIG. 5 is an elevational view of a piece of FIG. 4.
Figure 6:
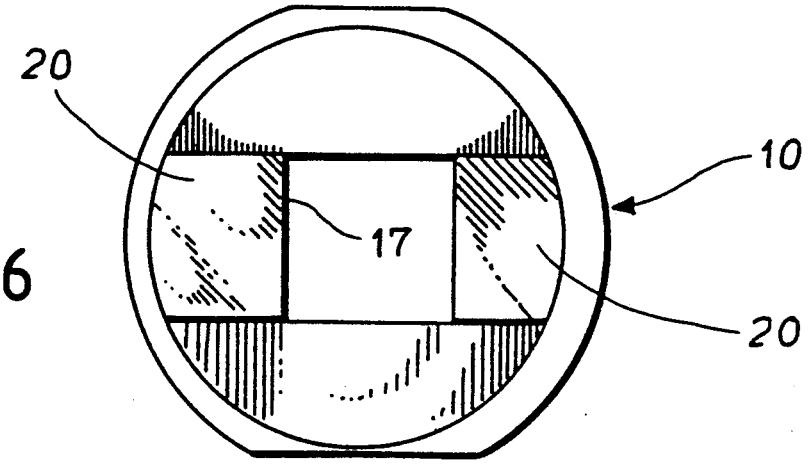
- FIG. 6 is a plan view of the piece of FIG. 5.

The second clamping piece 10 is housed between arm 2 and the portion 13 of plate 6. It is shown by itself in elevation and plan on FIGS. 5 and 6. It exhibits a cylindrical section 14 and two truncated sections **15*a* and 15*b* (see also FIG. 7). The thickness of section 15*a* varies progressively around the axis of such piece 10 as is shown on FIG. 4. The face 16 of section 14 is generally in the form of a spherical cap conceived in a manner to correspond to the source 12 of piece 9**.

The truncated section **15*b* caps the truncated section 15*a*, crosses over it and encroaches even on a portion of the cylindrical section as is shown on FIG. 7. The thickness of the truncated section 15*b* also varies around the axis of he second clamping piece 10. The truncated section 15***a* has as effect to produce an inclination of the axis of the clamping pieces 9, 10, 11 which, relative to a perpendicular to the arm 2, is on the order of 15° in the direction of the tail piece of the violin, i.e. in the longitudinal sense. As to section 15*b*, it has principally as effect to produce an inclination, also on the order of 15°, which distances piece 1 from the body 5 of the violin in the direction of the e string.

The embossed portion 13 of plate 6 is generally in the form of a spherical shell. It is squeezed between surface 12 of the first clamping piece and face 16 of the second clamping piece. Thanks to the forms of surface 12, of face 16 and of shell 13, such latter may pivot in the manner of a ball and socket joint relative to the first and second clamping pieces 9, 10. Piece 1 follows, as may be well understood, the movements of shell 13. The amplitude of such movements is not very great. From the position shown on FIGS. 4 and 7, it is however the same in all directions. It is thus amply sufficient for the adjustment needs of violinists.

The second clamping piece 10 provides a prismatic opening 17 the profile of which is preferably squared off. Such opening 17 receives a corresponding projection 18 from the first clamping pieces 9 in a manner such that the first and second clamping pieces 9, 10, are rigorously fixed to one another in rotation.

On its planar face 19 opposite the concave spherical face 16, the second clamping piece 10 provides finally a pair of spurs 20 which are diametrally opposed to one another. The height of such spurs 20 is approximately equal to half the thickness of the arm 2. Their width is equal to that of a longitudinal slot 21 provided in the center of the width of arm 2. The second clamping piece 10 has its planar face resting against arm 2 and spurs 20 projecting into the slot 21. By this arrangement, arm 2 blocks the first and second clamping pieces 9 and 10 from rotation.

The third clamping piece 11 is situated on the other side of arm 2 relative to the second clamping piece 10. It also rests against arm 2 by a planar face 22 and it also provides a pair of spurs 23 which are diametrally opposed and identical to spurs 20. They also enter slot 21 in blocking the third clamping piece 11 from rotation just as the other two. A portion 24 of the third clamping piece is thus nested in opening 17 of the second clamping piece. There results from the described arrangement that the three clamping pieces 9, 10, 11 are rigorously prevented from turning by arm 2.

The assembly of the three clamping pieces 9, 10, 11 and the support piece 1 is secured to the arm 2 by a cap screw 25 with a socket head 26. Head 26 is supported on a collar 27 of the fist clamping piece 9. Screw 25 goes through an opening 289 of shell 13, a bore 29 through the projection 18 of the first clamping piece 9, the opening 17 of the second clamping piece and the longitudinal slot 21 of the arm 2 to be finally fitted into the third clamping piece 11. When screw 25 is tightened, shell 13 and with it the support piece 1 is strongly gripped, thus immobilized between the first and second clamping pieces with the inclination and angle adjusted relative to arm 2. From the standard position of the support piece 1 relative to arm 2 which is shown on FIGS. 4 and 7, the necessary adjustments of inclination of the support piece are of very small amplitude. It will also be noted that in the standard position as described, opening 28 of the spherical shell 13 is symmetric relative to the axis of screw 25, the support piece thus being found in an intermediate position.

Since only screw 25 and spurs 20, 23 are fitted into the slot 21 of arm 2, the three clamping pieces 9, 10, 11 may evidently be displaced along with the support piece along such slot 21, when screw 25 is loosened somewhat. The same screw 25 thus serves to fasten the support piece 1 relative to arm 2 at the desired inclination, at the desired angle and the desired distance from the base 3 of the chin rest 4. Screw 25 may be acted on by means of a prismatic stem adapted to the form of socket 30 of head 26 of screw 25, such stem being introduced through a hole 31 of cushion 7.

In practice, the violinist adjusts the position, the angle and the inclination of support piece 1 once and for all. This may thus take place with the violin maker who sells instruments according to the invention. When screw 25 is completely tightened, there is no longer a risk that it become unscrewed, even if the support piece 1 is displaced following a shock, since the screw is in contact only with the first and third clamping pieces which arm 2 absolutely prevents from rotating.

Figure 3:
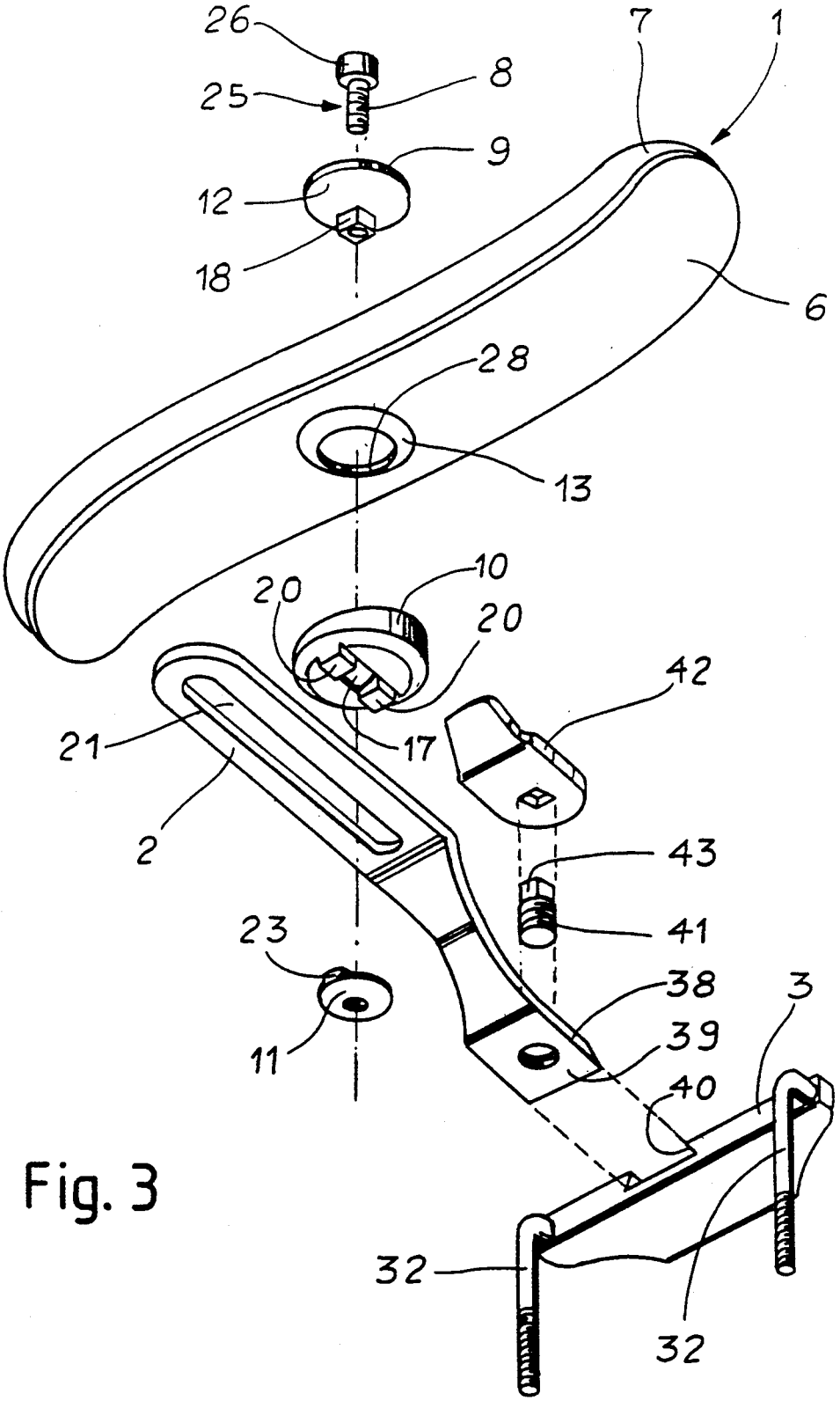
- FIG. 3 is an exploded perspective of the elements of the shoulder rest.

The base 3 of chin rest 4 is equipped during manufacture with two arms 32, the ends of which are threaded (FIG. 3). Chin rest 4 itself also bears two similar arms 33 (FIG. 2). Threaded sleeves 34 are fitted onto the corresponding threadings of arms 32 and 33 in order to strongly grip the violin between base 3 of the chin rest and the chin rest 4 itself so as to solidly secure such latter to the body 5 of the violin. The arms 32, 33 and sleeves 34 thus form a pair of risers 35.

Many violinists play with a central chin rest, i.e. a chin rest the risers 35 of which are located on either side of pin 36 of the tail piece 37 as shown on FIG. 2. There are however violinists who wish a side chin rest, i.e. a chin rest the two risers 35 of which are at the same side of the tail piece towards the g string. In both cases, the same support may be employed. For this the three clamping pieces 9, 10, 11, screw 25 and hole 31 are not in the center of the length of the support piece 1 but offset therefrom. Relative to the case of the central chin rest (FIG. 2), it is sufficient to rotate the support piece 180° relative to arm 2 in order to render the support described employable with a lateral chin rest.

FIG. 3 shows in exploded perspective the parts which serve to attach the support piece 1 to arm 2. At the same time it is useful to recall that the first clamping piece 9 is set on the spherical shell 13 in order to secure cushion 7 to plate 6 of the arm 2. FIG. 3 also shows details of the securing of such arm 2 to the base 3 of chin rest 4. To this end sides 38 of the end 39 of arm 2 are inclined and base 3 of the chin rest exhibits an opening in the form of a dovetail 40. The end 39 of arm 2 is fitted with play into opening 40. A screw 41 is fitted into threading in the end 39 of arm 2. In bearing against base 3 of the chin rest, such screw 41 strongly presses the sides 38 of arm 2 against those of the opening 40 which constitutes a rigid fastening producing no unseemly noise.

This securing of arm 2 to the base 3 of the chin rest must be effected by the violinist before and after each performance, since in order to place the violin into its case, the support according to the invention must be removed. In order that the violinist is not obliged to carry a special wrench or screwdriver in order to operate screw 41 and manipulate it, a tongue 42 is permanently fastened to the end 43 of screw 41 projecting from arm 2. It is sufficient to operate the tongue 42 in order to tighten and loosen screw 41. In order to simplify still further this securing arrangement of arm 2 to base 3 of the chin rest, it is arranged in a manner such that tongue 42 is exactly superposed onto arm 2 when the screw 41 is tightened to the maximum.

What I claim is:

1. A shoulder rest for a longitudinally extending violin, comprising a support piece intended to lie against a shoulder of a violinist, said support piece being rigidly secured to one end of an elongated arm in a manner to enable adjusting both a position of the support piece along said one end of said arm, and also longitudinal and transversal inclinations of said support piece relative to said arm, said arm being rigidly secured at an opposite end thereof to a base of a chin rest located over the violin, said shoulder rest further comprising a single cap screw rigidly fixing the support piece to said arm in the position as adjusted, both along the arm and at said longitudinal and transversal inclinations to said arm, said cap screw passing through a first clamping piece, said support piece, a second clamping piece and said arm so as to engage with a third clamping piece and thereby compress together the arm, the support piece and the first and second clamping pieces, wherein the first and second clamping pieces are provided with complementary surfaces at least approximately in a form of respectively convex and concave spherical caps, and wherein the support piece comprises a portion having a form approximating a spherical shell gripped between the first and second clamping pieces; and wherein a head of the aforesaid cap screw bears on he first clamping piece.

2. A shoulder rest for a longitudinally extending violin, comprising a support piece intended to lie against a shoulder of a violinist, said support piece being rigidly secured to one end of an elongated arm in a manner to enable adjusting both a position of the support piece along said one end of said arm, and also longitudinal and transversal inclinations of said support piece relative to said arm, said arm being rigidly secured at an opposite end thereof to a base of a chin rest located over the violin, said shoulder rest further comprising a single cap screw rigidly fixing the support piece to said arm in the position as adjusted, both along the arm and at said longitudinal and transversal inclinations to said arm, said cap screw passing through a first clamping piece, said support piece, a second clamping piece and said arm so as to engage with a third clamping piece and thereby compress together the arm, the support piece and the first and second clamping pieces, wherein eh first and second clamping pieces are provided with complementary surfaces at least approximately in a form of respectively convex and concave spherical caps, and wherein the support pieces comprises a portion having a form approximating a spherical shell gripped between the first and second clamping pieces; and wherein, in a concentric position of said complementary surfaces of the first and second clamping pieces and the shell-formed portion of the support piece, said support piece has a first inclination relative to said arm in a longitudinal direction of the violin in approaching a tailpiece thereof and a second inclination in a transversal direction of the violin going away from the violin in a direction of an e-string thereof.

3. A shoulder rest as set forth in claim 2 wherein said first and second inclinations are approximately 15°.

4. A shoulder rest as set forth in claim 2 wherein the second clamping piece has a thickness which varies progressively around an axis of said second clamping piece, in order to provide said first and second inclinations of the support piece relative to said arm.

5. A shoulder rest for a longitudinally extending violin, comprising support piece intended to lie against a shoulder of a violinist, said support piece being rigidly secured to on end of an elongated arm in a manner to enable adjusting both a position of the support piece along said one end of said arm, and also longitudinal and transversal inclinations of said support piece relative to said ar, said arm being rigidly secured at an opposite end thereof to a base of a chin rest located over the violin, said shoulder rest further comprising a single cap screw rigidly fixing the support piece to said arm in the position as adjusted, both along the arm and at said longitudinal and transversal inclinations to said arm, said cap screw passing through a first clamping piece, said support piece, a second clamping piece and said arm so as to engage with a third clamping piece and thereby compress together the arm, the support piece and the first and second clamping pieces, wherein the first and second clamping pieces are provided with complementary surfaces at least approximately in a form of respectively convex and concave spherical caps, and wherein the support piece comprises a portion having a form approximating a spherical shell gripped between the first and second clamping pieces;

wherein said cap screw passes through a longitudinal slot in said arm so that said cap screw, together with the first, second and third clamping pieces and said support piece may occupy any position along said longitudinal slot, thereby permitting adjustment of said support piece to any position long said longitudinal slot;

wherein the clamping pieces have non-circular portions which are nested into one another and also in said slot in said arm, thereby blocking rotation of said clamping pieces; and wherein the non-circular portions of said first, second and third clamping pieces are formed, on the second and third clamping pieces, by a pair of diametral spurs which fit into said longitudinal slot in the arm so as to be blocked from rotation, and on the first and second clamping pieces, by prismatic portions which nest into one another.

* * * * *